US007255659B2

(12) United States Patent
Jones

(10) Patent No.: US 7,255,659 B2
(45) Date of Patent: Aug. 14, 2007

(54) FORMULATION FOR BLOOD CLOT INHIBITOR FOR USE WITH BOW HUNTING BROADHEADS AND METHOD FOR USING SAME

(76) Inventor: Brandon Chad Jones, P.O. Box 131, Watson, LA (US) 70786

( * ) Notice: Subject to any disclaimer, the term of this patent is extended or adjusted under 35 U.S.C. 154(b) by 2 days.

(21) Appl. No.: 11/206,463

(22) Filed: Aug. 18, 2005

(65) Prior Publication Data

US 2006/0040772 A1 Feb. 23, 2006

Related U.S. Application Data

(60) Provisional application No. 60/603,691, filed on Aug. 21, 2004.

(51) Int. Cl.
*F42B 6/08* (2006.01)
*A01M 31/00* (2006.01)

(52) U.S. Cl. ..... 473/583; 43/1

(58) Field of Classification Search ..... 43/1; 473/578, 583, 584; 124/23.1
See application file for complete search history.

(56) References Cited

U.S. PATENT DOCUMENTS

| | | | | | |
|---|---|---|---|---|---|
| 2,467,838 | A | * | 4/1949 | Lust et al. | 473/581 |
| 3,066,940 | A | * | 12/1962 | De Lonais | 473/581 |
| 4,380,340 | A | * | 4/1983 | Simo | 473/578 |
| RE34,397 | E | * | 10/1993 | DelMonte et al. | 473/584 |
| 2005/0233061 | A1 | * | 10/2005 | Schwarz | 427/2.1 |

* cited by examiner

*Primary Examiner*—John A. Ricci

(57) ABSTRACT

A method and formulation are disclosed toward the enhancing of a blood trail by a wounded target animal. A topical application for use with broadheads is disclosed as well as a method for using same.

6 Claims, 2 Drawing Sheets

FORMULATION FOR BLOOD CLOT INHIBITOR FOR USE WITH BOW HUNTING BROADHEADS AND METHOD FOR USING SAME

CROSS-REFERENCE TO RELATED APPLICATIONS

This application claims the benefit of Provisional Application for Patent # 60/603,691 filed Aug. 21, 2004, the contents of which are hereby incorporated by reference.

FIELD OF THE INVENTION

The present invention relates to bow hunting and specifically to a formulation for inhibiting blood clotting resulting from a arrow wound inflicted on a prey animal and a method for using same.

BACKGROUND OF THE PRIOR ART

Bow hunting is one of mans' oldest arts and has benefited over time from technological improvements towards the fundamental equipment namely the bow and arrow, including various parts and materials therefor. Regarding the arrow, stone points have replaced bare wood. Metal points and metal broad heads replaced the stone points. Countless alterations have been made toward these and other fundamentals.

The hunting of big game, e.g., deer, elk, etc., with bows and arrows is becoming a popular activity in the United States. In fact, many states have special archery seasons during which hunting with a firearm is prohibited. While improvements in bows and arrows have made the average bow hunter more proficient in inflicting a fatal wound, harvesting big game, such as deer, elk, etc., with a bow and arrow is still less efficient than with a firearm. Many large caliber bullets are designed to wreak havoc on tissues and organs due to terminal ballistic characteristics designed thereinto. Such is not the case with arrowheads. A problem that often arises with bow hunting concerns the tracking and locating of a wounded or "hit" animal for harvesting.

Once a big game animal is hit by an arrow, it may run a considerable distance prior to incapacitation and collapse. A hunter desiring to harvest the animal is thus required to track the animal, typically by following a trail of blood on the ground left by the running animal. At times, such a trial may become sparse and difficult to follow, and may merely consist of a drop of a blood every so many feet or yards. While a hunter hunting with snow on the ground may follow the tracks of the animal should the blood trail run dry, tracking an animal in this manner often proves extremely difficult when there is no snow on the ground. Even with snow on the ground, such tracking is difficult as tracks from other animals are typically dispersed over the ground surface.

Various prior art attempts have been made toward aiding in blood flow by means of mechanical improvements for the broadhead and/or the arrow. U.S. Pat. No. 6,705,808 issued to Kane teaches an arrow shaft with a plurality of holes and channels for the purpose of allowing less restricted blood flow. One problem with this arrow is that it does not address the capacity of blood to clot around the entry wound. Also, this type arrow would be expensive to make and would diminish the tensile strength of the arrow. Another problem with a device of this nature is that typically the arrow will, due to the very high velocity of modern bows, exit the animal rendering this capacity irrelevant.

U.S. Pat. No. 4,380,340 issued to Simo teaches a bleeder attachment for arrows in which a bulbous addition to the standard arrow is disclosed in which a plurality of forward facing barbs are present. And while this type device could inflict a more serious wound, it would also negatively affect the flight characteristics of the arrow while in flight in the form of added drag. Also this type device would not affect the ability of the blood to clot around the wound opening. The barbs associated with this device would also hinder tissue penetration.

U.S. Pat. No. 3,066,940 issued to De Lonais teaches an arrow capable of injecting a tranquilizer into the target animal. Again this type arrow would be expensive to manufacture and would provide a danger to the consumer of meat in which animal tranquilizer might still be present, active and dangerous.

SUMMARY

Objects of the present invention are to overcome the deficiencies of the prior art in enhancing blood flow from a wounded target animal in order to aid in the tracking thereof.

The present invention relates to a safe topical formulation for use with an arrowhead in which blood flow is enhanced biochemically thereby and a method for using same.

DESCRIPTION OF THE INVENTION

A First Embodiment of the Invention

A topical viscous solution is provided for the application thereof onto the surface of a hunting broadhead, whereby and upon penetrating the hide of a target animal an amount of the solution will gather at the wound site sufficient to inhibit clotting, promoting blood flow thereby from the wound site.

A exemplary constituent list is provided below with percentages provided in the column to the right.

| | |
|---|---|
| distilled water | 42.5% |
| glycerin | 27.0 |
| xanthan gum | 1.5 |
| guar gum | 1.5 |
| epsom salt | 5.0 |
| iodized salt | 10.0 |
| trisodium citrate | 7.0 |
| tumeric | 3.0 |
| white willow bark | 1.0 |
| ginger | 1.0 |
| fenugreek | 0.5 |

The solution is formulated by thoroughly mixing the ingredients listed heretofore.

Trisodium citrate is a known anti clotting agent used in the meat packing art. Glycerin, guar and zanthan gums are know thickeners for a myriad of food products ranging from salad dressings to various condiments, soups and sauces.

Figure 1:
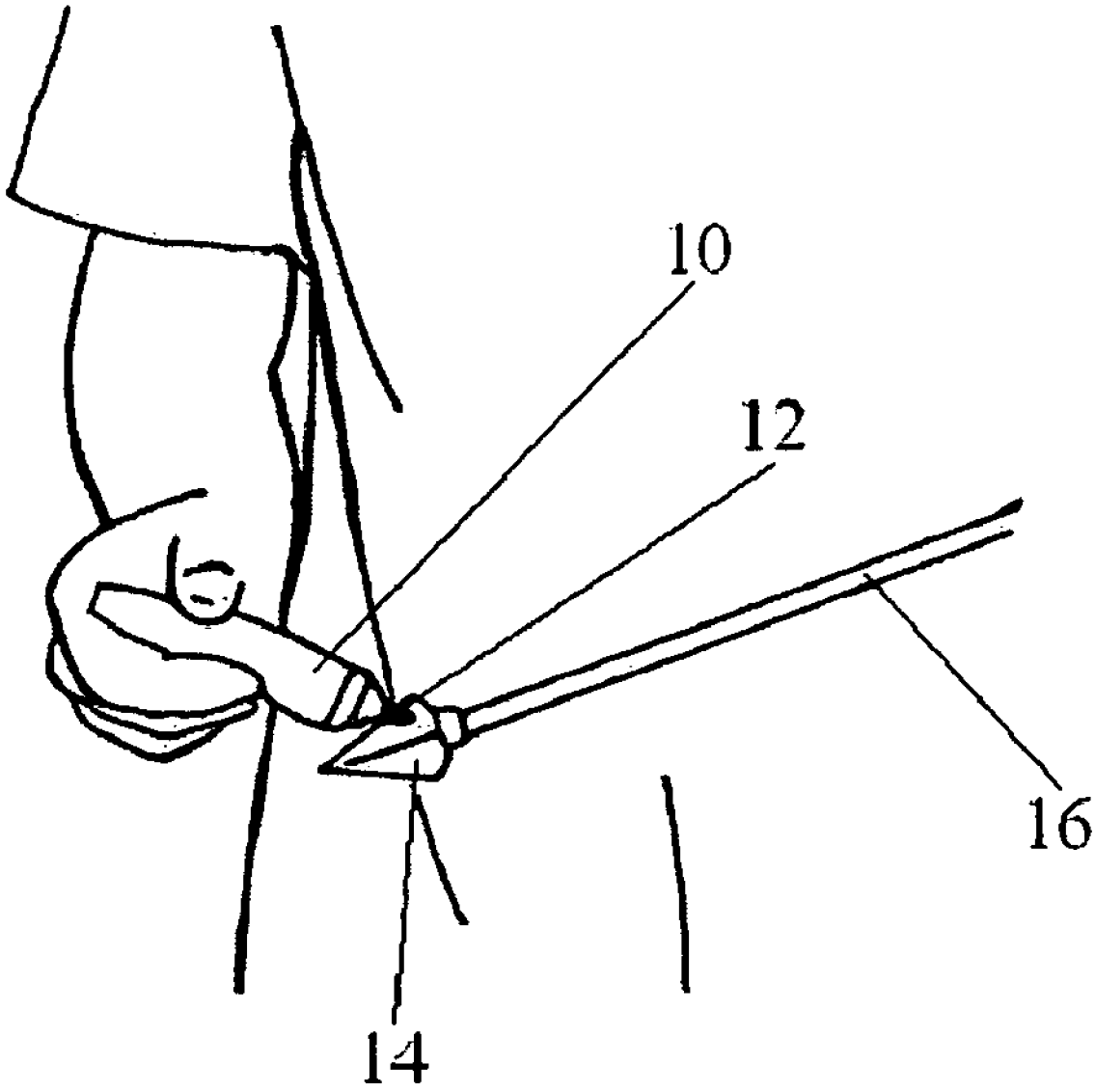
FIG. 1 shows a front elevation of a hunter applying the anti-coagulant to a broadhead.

Referring now to the drawings, FIG. 1 shows a hunter holding a tube of the solution 10 and applying a bead 12 thereof onto a blade of a broadhead 14. Though not shown, the hunter would grasp the shaft 16 of the arrow for this purpose.

Figure 2:
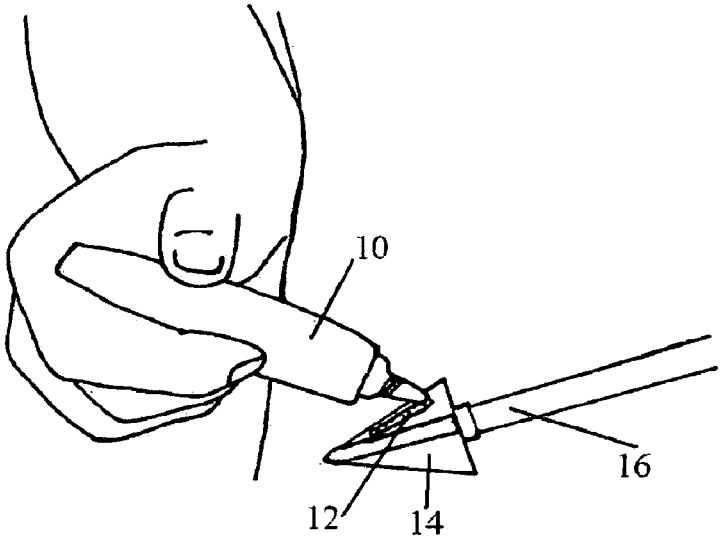
FIG. 2 shows an enlarged view the application of the anti-coagulant to the broadhead.

FIG. 2 shows an enlarged view in which the bead 12 is applied down the length of the blade 14 by means of expressing the solution from the tube 10.

Figure 3:
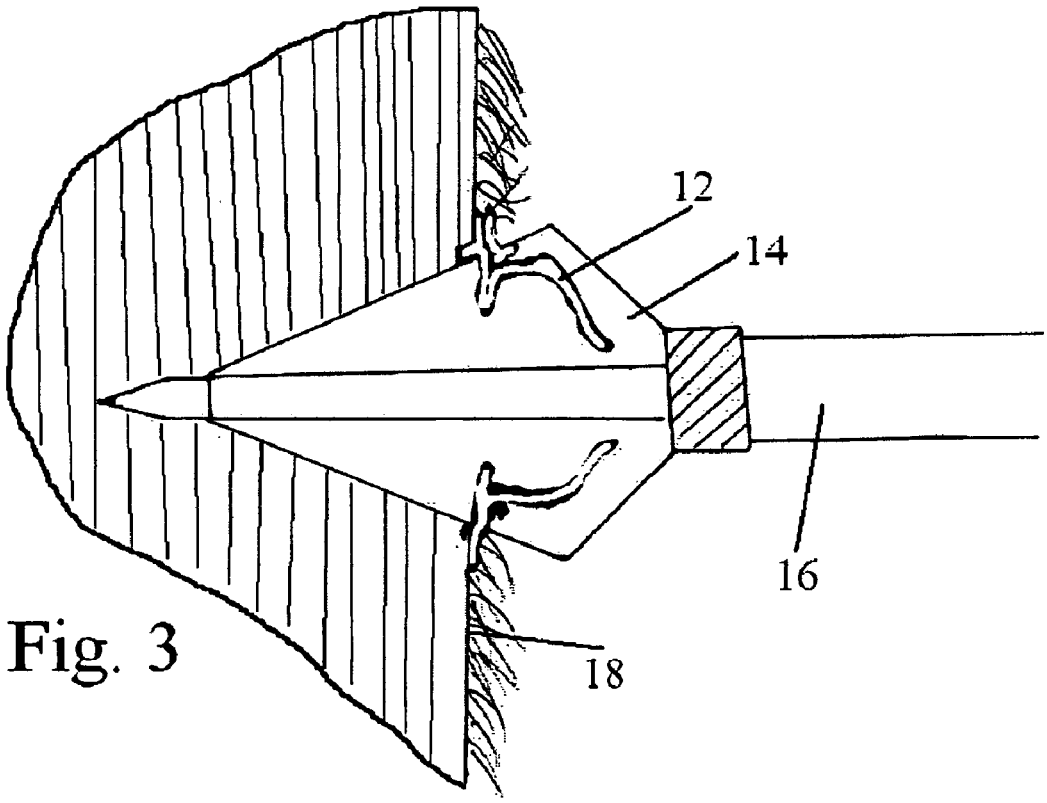
FIG. 3 shows a sectional view of the penetrating impact of the applied broadhead with the hide of a target animal.

FIG. 3 shows a sectional view of the penetrating impact of the arrow into a target animal, wherein the topical solution 12 is wiped onto the surface and inner face of a wound inflicted to the hide 18 of the target animal.

A Second Embodiment of the Invention

With regard to a second embodiment, the following constituents may be combined as with the previous embodiment and used accordingly.

| | |
|---|---|
| distilled water | 50.0% |
| glycerin | 35.0 |
| xanthan gum | 5.0 |
| trisodium citrate | 10.0 |

A topical viscous solution is provided in order to enhance the blood flow of a targeted game animal by means of a broad head wound in which the solution has been transferred in, onto and around the surface thereof.

It should be noted that other type media for providing a viscous solution are available such as petroleum jelly and the like.

The advantages of this invention are self-apparent. The anti-clotting solution having been wiped onto the wound opening would enhance blood flow to the extent that tracking the game animal would be aided to the hunter thereby due to a less broken blood trail as would typically be available given a similar wound absent the applied solution.

Ordinarily coagulation is initiated within seconds after an injury occurs. Platelets form the initial plug within the injured tissues as well as the entry site. Following primary hemostasis other blood plasma cells, often called clotting factors, by means of a complex cascade, form strands in order to strengthen the platelet plug. Transferring the anti-clotting solution of the present invention to the wound site disrupts this phenomenon enhancing unobstructed blood flow thereby. It should be noted that the instant invention does not make a non-lethal wound lethal. And while the blood flow from a non fatal wound would be enhanced, it would be done so only marginally, much like wounds produced by a leach or vampire bat due to the anticoagulants used by these animals toward maintaining blood flow.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention as claimed hereinafter. It should be noted that exotic fluids from various animals could also be used toward practicing the present invention, namely those from leaches and vampire bats, and while being difficult and expensive to procure, could have beneficial results toward enhancing blood flow from a wounded game animal.

I claim:

1. In a method for hunting a game animal by a hunter with a bow and arrow, said arrow having a broad head, a shaft and fletching, said arrow intended for causing an incapacitating wound into the hide and throughout the various internal tissues of said game animal comprising the steps of a. providing said bow and arrow, b. launching said arrow by said hunter from said bow with the intent of incapacitating said game animal, the improvement comprising the step of releasably applying an anticoagulant to at least part of said arrow prior to the launch thereof;

whereby and upon inflicting said incapacitating would, blood flow is enhanced at the point of said wound as a result of said anticoagulant being dispersed at the wound site, where as said hunter would more easily be able to track said game due to the enhanced blood flow from the entry wound and possibly the exit wound and the inherent blood trail provided thereby.

2. The method of claim 1 wherein said topical solution is comprised of a viscous carrier and an anti-clotting agent and that said topical solution is applied to said broadhead.

3. The method of claim 2 wherein said carrier is comprised of a solution of water and a means for thickening said water.

4. The method of claim 3 wherein said thickening means is comprised of an amount of xanthan gum sufficient to enhance the viscosity of said water.

5. The method of claim 4 wherein said thickening means further includes glycerin.

6. The method of claim 2 wherein said anti-clotting agent is comprised of an amount of trisodium citrate sufficient to enhance blood flow.

* * * * *